US008439226B2

(12) United States Patent
Fort et al.

(10) Patent No.: US 8,439,226 B2
(45) Date of Patent: May 14, 2013

(54) LIQUID DISPENSING VALVE AND METHODS

(75) Inventors: Wesley C. Fort, Cumming, GA (US); Mark A. Gould, Gainesville, GA (US)

(73) Assignee: Nordson Corporation, Westlake, OH (US)

( * ) Notice: Subject to any disclaimer, the term of this patent is extended or adjusted under 35 U.S.C. 154(b) by 1025 days.

(21) Appl. No.: 12/367,609

(22) Filed: Feb. 9, 2009

(65) Prior Publication Data

US 2009/0206112 A1 Aug. 20, 2009

Related U.S. Application Data

(60) Provisional application No. 61/029,731, filed on Feb. 19, 2008.

(51) Int. Cl.
*B65D 47/00* (2006.01)

(52) U.S. Cl.
USPC ..... 222/1; 222/146.5; 222/326; 222/387; 222/389; 222/394; 118/685; 239/456; 239/541; 251/340; 251/347

(58) Field of Classification Search .... 222/146.1–146.2, 222/146.5, 325–327, 333–334, 387, 389, 222/394, 504, 544–559, 561; 118/684–685; 239/270, 239/456, 537, 541; 251/324, 340, 347; 137/382, 137/382.5
See application file for complete search history.

(56) References Cited

U.S. PATENT DOCUMENTS

| | | | | | |
|---|---|---|---|---|---|
| 2,659,517 | A * | 11/1953 | Reinhardt, Jr. | ..... | 222/82 |
| 4,104,983 | A * | 8/1978 | Carstedt | ..... | 118/685 |
| 4,215,802 | A * | 8/1980 | Ornsteen | ..... | 222/146.2 |
| 5,074,443 | A * | 12/1991 | Fujii et al. | ..... | 222/639 |
| 6,089,413 | A * | 7/2000 | Riney et al. | ..... | 222/318 |
| 6,354,471 | B2 * | 3/2002 | Fujii | ..... | 222/380 |
| 7,296,714 | B2 * | 11/2007 | Byerly | ..... | 222/504 |

* cited by examiner

*Primary Examiner* — Kevin P Shaver
*Assistant Examiner* — Andrew P Bainbridge
(74) *Attorney, Agent, or Firm* — Wood, Herron & Evans, L.L.P.

(57) ABSTRACT

A dispensing valve is provided for dispensing liquid from a cartridge. The valve includes a valve body that is adapted to receive at least a portion of the cartridge therein. A valve member is disposed in the valve body and is adapted for fluid communication with the cartridge. A valve seat element is disposed in the valve body and includes a liquid chamber that is in communication with the liquid outlet and is mounted for reciprocating movement between a closed position engaged with the valve member to prevent liquid from exiting the liquid outlet and an open position disengaged from the valve member to allow liquid to flow from the liquid chamber through the liquid outlet. The valve body may include a longitudinal axis and a receive bore extending along the longitudinal axis, with the liquid outlet being substantially coaxial with the receiving bore.

13 Claims, 6 Drawing Sheets

LIQUID DISPENSING VALVE AND METHODS

This application claims the priority of U.S. Provisional Patent Application Ser. No. 61/029,731, filed on Feb. 19, 2008, the disclosure of which is incorporated by reference herein.

TECHNICAL FIELD

This invention is related to apparatus and methods for dispensing liquids and, more particularly, to apparatus and methods for dispensing liquids from a cartridge.

BACKGROUND

In certain applications it is sometimes necessary to dispense liquids out of a cartridge or similar container and onto a desired target. For example, in the electronics industry, materials such as polyurethane reactive ("PUR") adhesives may be dispensed out of a syringe-like cartridge and onto a desired target. Conventional apparatus for dispensing viscous liquids from cartridges may result in stringing of the liquid, and this can negatively affect quality and/or control of the dispensing operation.

There is a need, therefore, for apparatus and methods that address these and other issues associated with conventional apparatus and methods.

SUMMARY

In one embodiment, a dispensing valve includes a valve body that is adapted to receive at least a portion of the cartridge therein. A valve member is disposed in the valve body and is adapted for fluid communication with the cartridge. A valve seat element is disposed in the valve body. The valve seat element includes a liquid chamber with a liquid outlet and is mounted for reciprocating movement between a closed position engaged with the valve member to prevent liquid from exiting the liquid outlet and an open position disengaged from the valve member to allow liquid to flow from the liquid chamber through the liquid outlet. The valve body may include a longitudinal axis and a receiving bore extending along the longitudinal axis, with the liquid outlet being substantially co-axial with the receiving bore. Additionally or alternatively, the valve body may include a longitudinal axis and the valve seat element is mounted for reciprocating movement substantially along the longitudinal axis.

The valve body may include a luer connector that is adapted for coupling with the cartridge. The liquid outlet may be disposed in the valve seat element for movement therewith between the open and closed positions. At least one of the valve member or the valve seat element may be formed of a plastic material. The valve body may include an air inlet for receiving actuation air there through, with the valve seat element being in communication with the air inlet and being movable between the open and closed positions by action of the actuation air. The valve body may include a detachable distal portion, with removal of the detachable distal portion providing access to the valve seat element.

In another embodiment, an assembly is disclosed for dispensing liquid from a cartridge. The assembly includes a valve body that is adapted to receive at least a portion of the cartridge therein. A solenoid valve is coupled to the valve body and is in fluid communication therewith. A valve member is disposed in the valve body and is adapted for fluid communication with the cartridge. A valve seat element is disposed in the valve body and has opposed surfaces in communication with the solenoid valve and a liquid chamber with a liquid outlet. The valve seat element is mounted for reciprocating movement between a closed position engaged with the valve member to prevent liquid from exiting the liquid outlet and an open position disengaged from the valve member to allow liquid to flow from the liquid chamber through the liquid outlet. The reciprocating movement is effected by selective directing of actuation air from the solenoid valve against one of the opposed surfaces of the valve seat element. The valve body may include an actuation air inlet that is adapted for coupling with a source of air, with the actuation air inlet extending through the valve body and communicating with a solenoid air inlet for feeding of actuation air into the solenoid valve.

In yet another embodiment, a method of dispensing liquid from a cartridge supported within a bore of a valve body includes maintaining a valve member with a liquid flow passage fluidly coupled to the cartridge and substantially fixed relative to the valve body. A valve seat element reciprocates between open and closed positions respectively into engagement and out of engagement with the valve member to control flow of the liquid from the cartridge through the liquid flow passage and out of the valve body. The method may include coupling the valve member with the cartridge outside of the valve body prior to insertion of the cartridge into the bore of the valve body. Alternatively or additionally, the method may include pressurizing the liquid within the cartridge. The method may include heating the liquid in the cartridge through the valve body.

DETAILED DESCRIPTION

Figure 1:
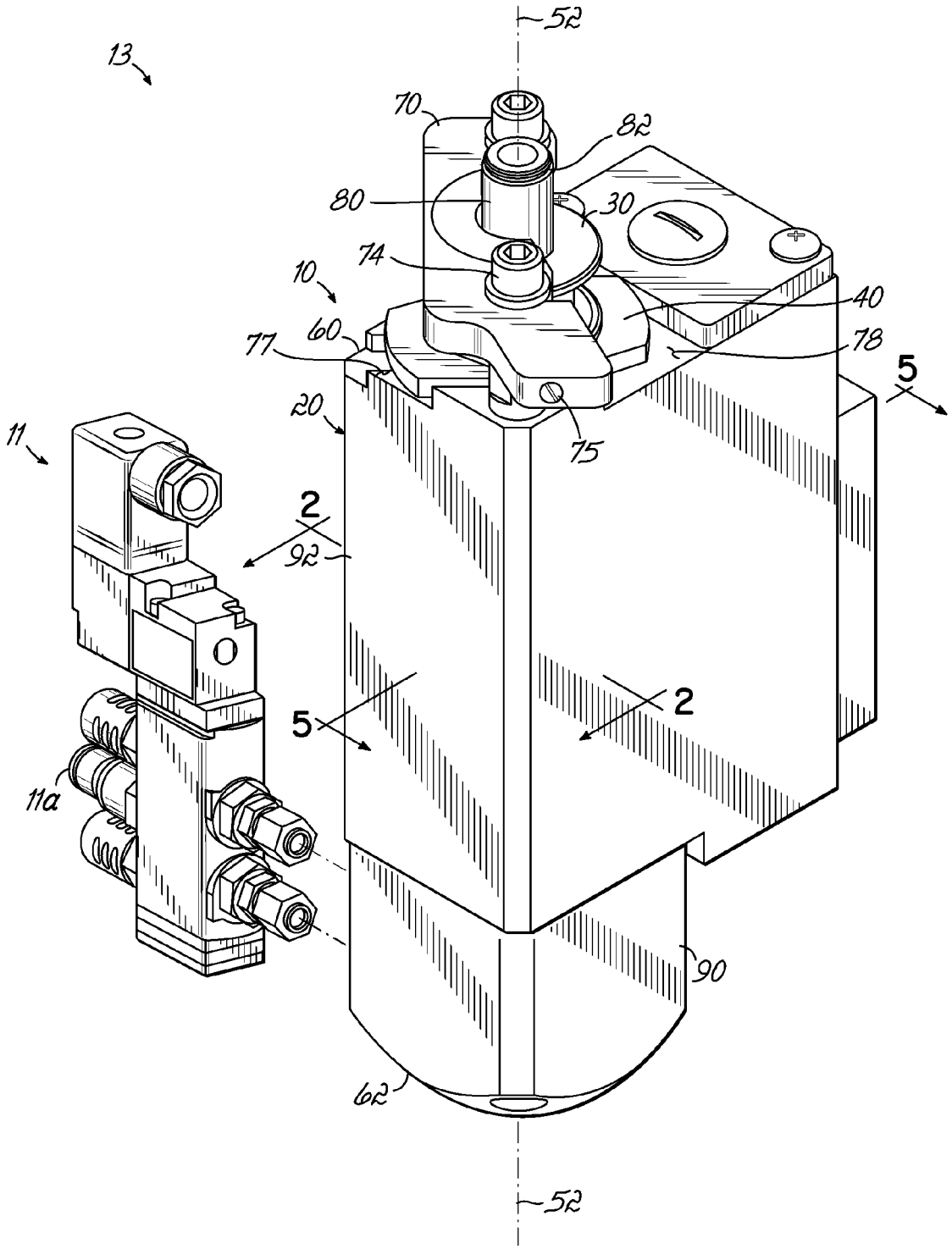
FIG. 1 is a perspective view of an assembly for dispensing a liquid out of a cartridge in accordance with one embodiment of the invention.

With reference to the figures, and more particularly to FIGS. 1-5, a dispensing valve 10 is shown for dispensing a liquid 12 such as, and without limitation, polyurethane reactive (PUR) adhesive from a cartridge 14 containing such liquid 12. A solenoid valve 11 is coupled to the valve 10 for selectively supplying actuation air to the valve 10, as further explained below. Jointly, the valve 10 and solenoid valve 11 define an assembly 13 for dispensing the liquid 12 from cartridge 14. The valve 10 includes a valve body 20 configured to receive at least a portion of the cartridge 14 therein to facilitate dispensing of the liquid 12 onto a target such as a schematically-depicted electronic component 22. In this exemplary embodiment, valve 10 is configured for dispensing liquid 12 from an exemplary syringe-like cartridge 14 having a barrel 24 that defines a volume containing the liquid 12. Barrel 24 extends between proximal and distal ends 26, 28 of cartridge 14 and includes a coupling portion for coupling the cartridge 14 with a cooperating feature of the valve 10, as further discussed below. A cap 30 is disposed at the proximal end 26 of the cartridge 14 and blocks access to the liquid 12.

An orifice 32 in cap 30 permits injection of pressurized air there through to pressurize the interior 34 of barrel 24 and thereby facilitates dispensing of the liquid 12 through a dispensing aperture 36 at the distal end 28 of cartridge 14. A gripping portion 40 of cartridge 14 facilitates manipulation thereof into and out of a receiving bore 50 of the valve 10 and further facilitates control of the distal placement of the cartridge 14 within valve body 20.

Figure 2:
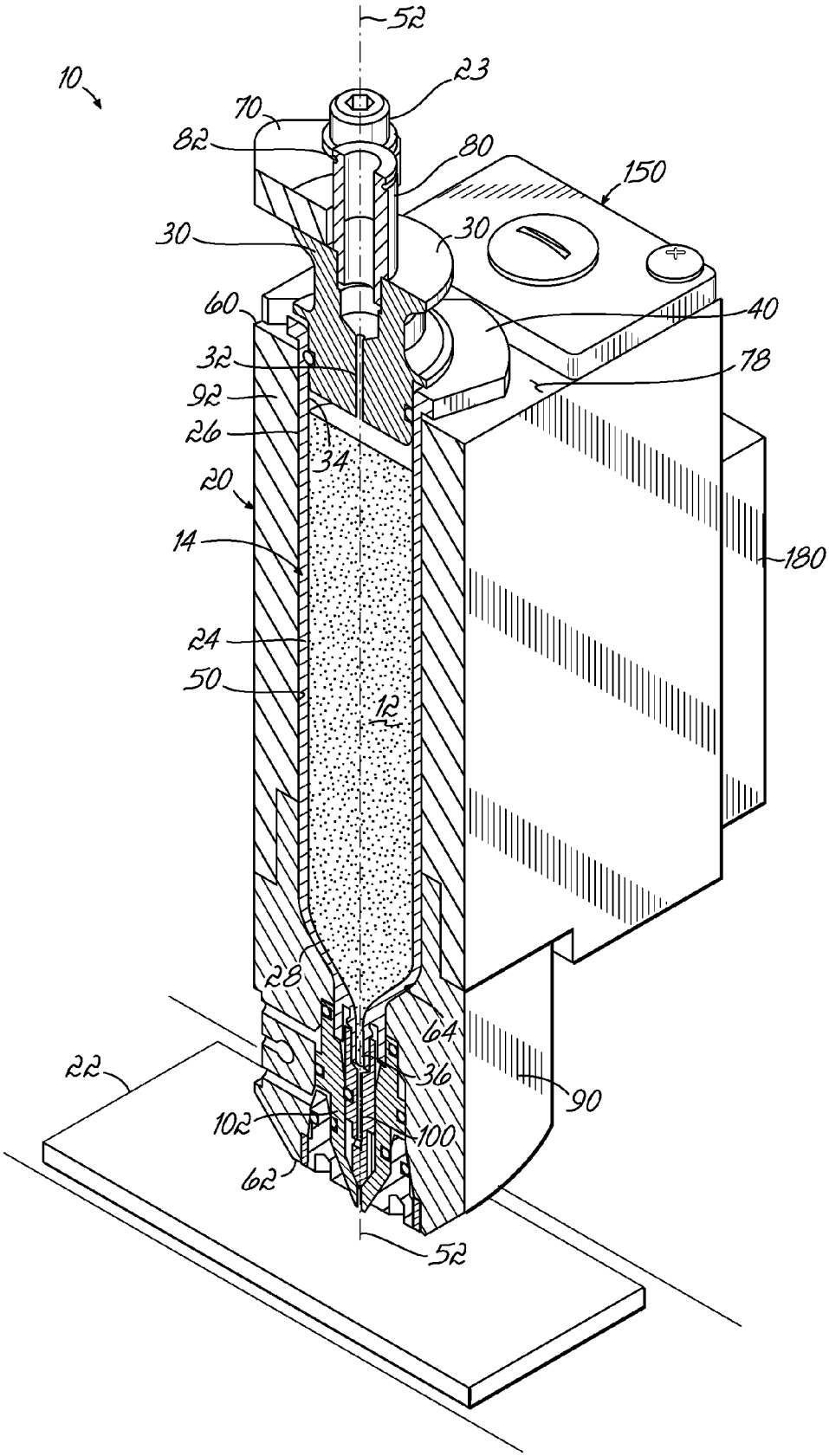
FIG. 2 is a view taken generally along line 2-2 of FIG. 1.
Figure 2A:
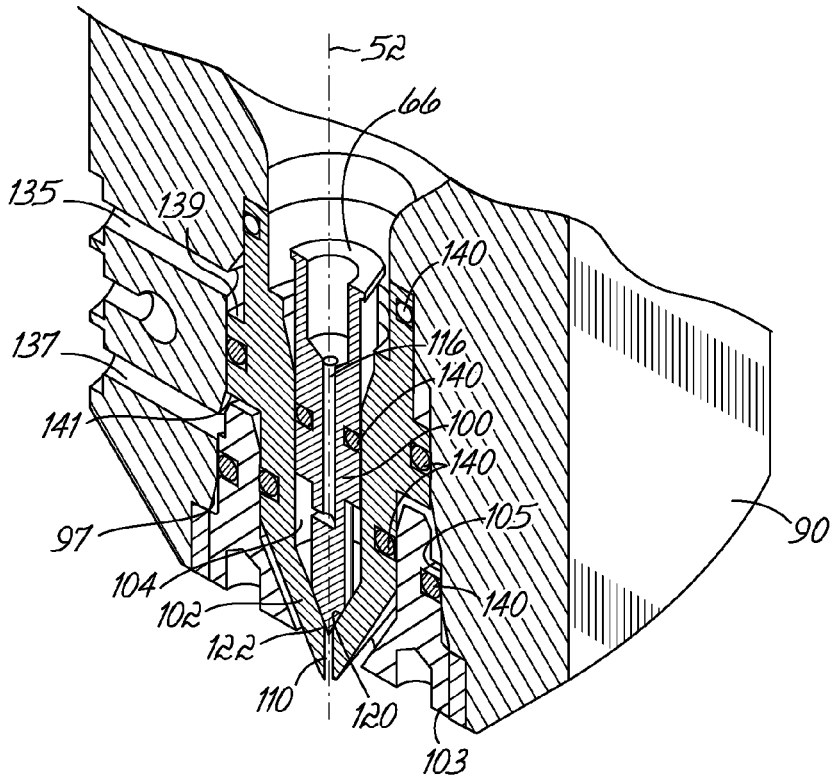
FIG. 2A is a partially sectioned perspective view of a portion of the dispensing valve of FIGS. 1 and 2.
Figure 2B:
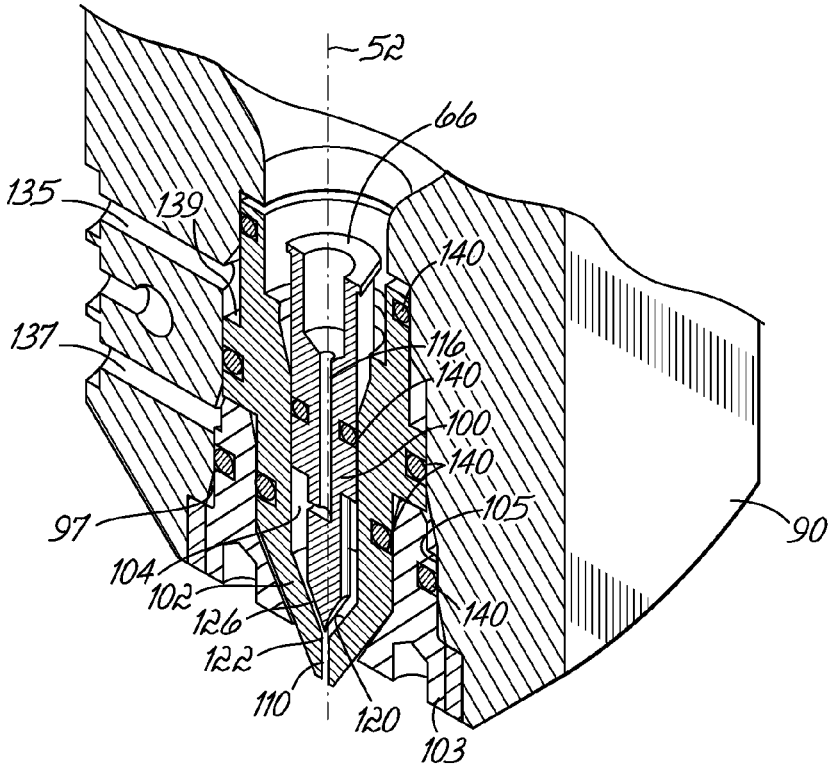
FIG. 2B is a partially sectioned perspective view similar to FIG. 2A showing a valve seat element in an open position.
Figure 3:
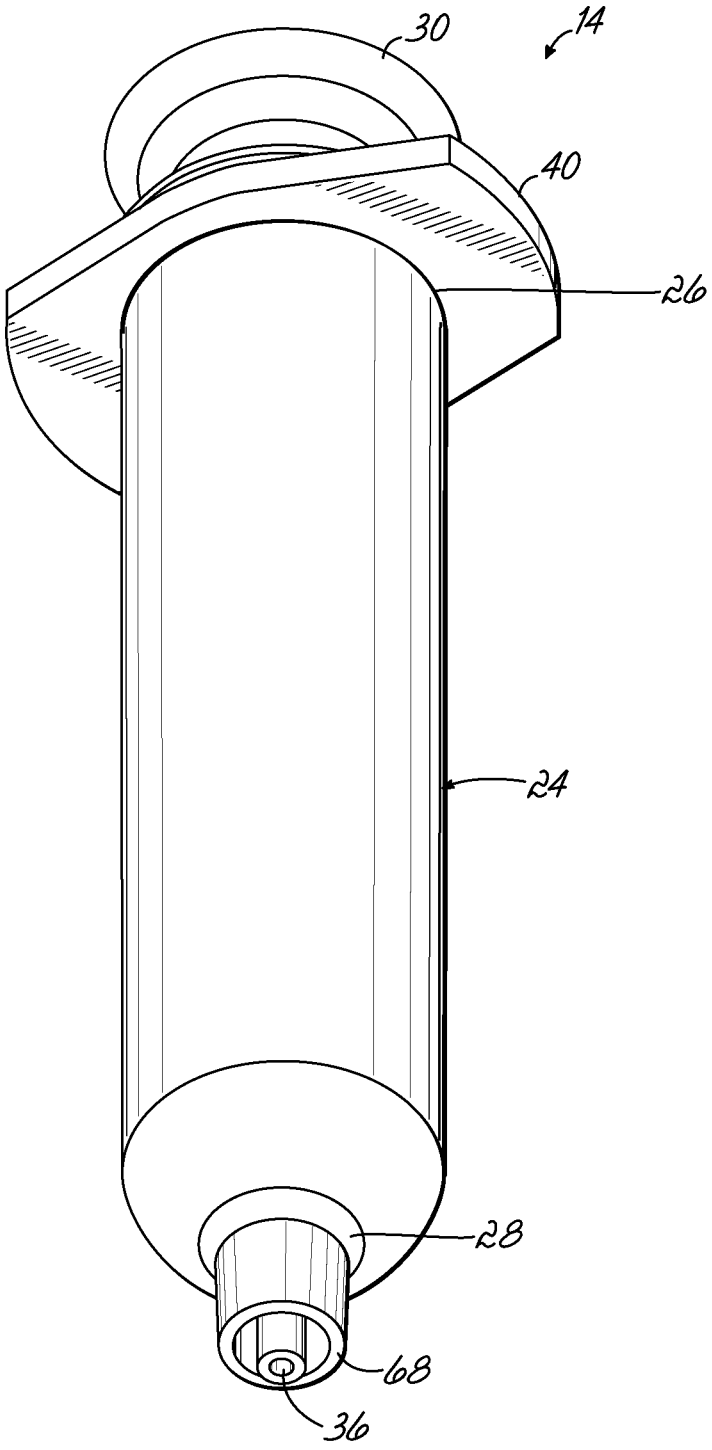
FIG. 3 is a perspective view of an exemplary cartridge.
Figure 4:
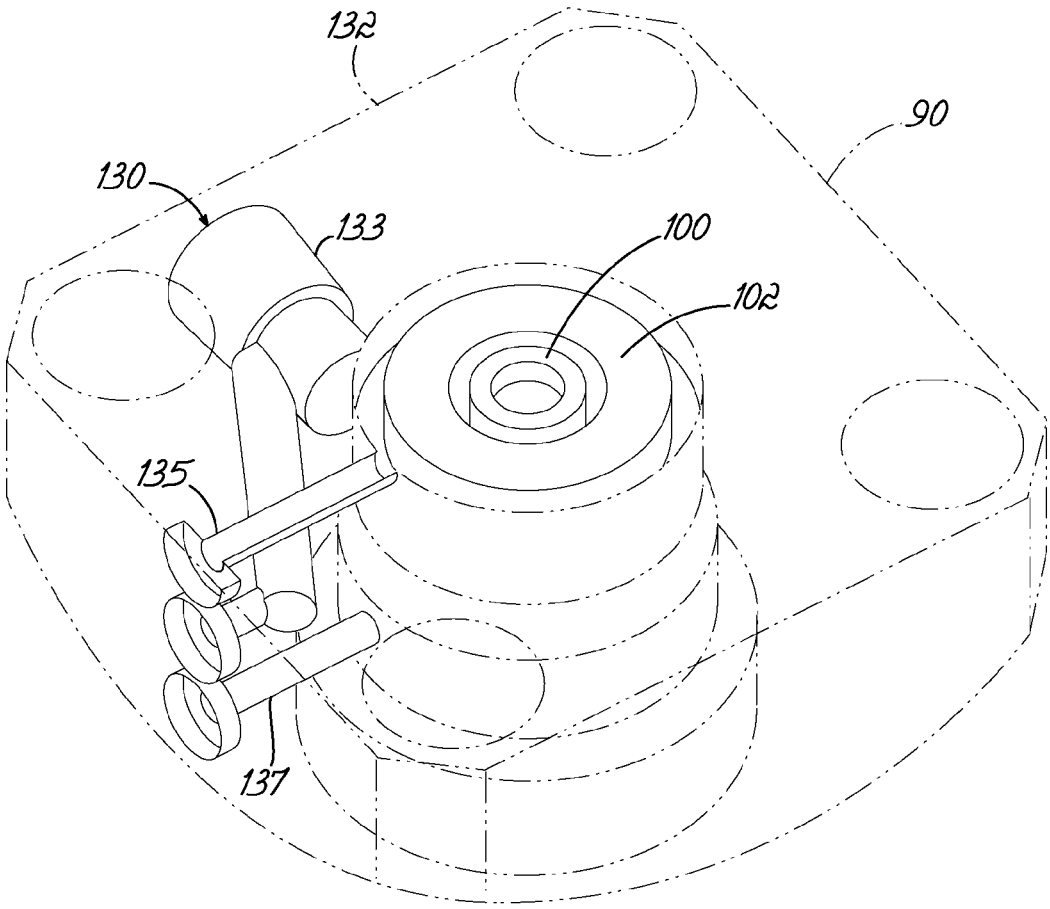
FIG. 4 is a perspective translucent view of a portion of the dispensing valve of FIGS. 1 and 2.
Figure 5:
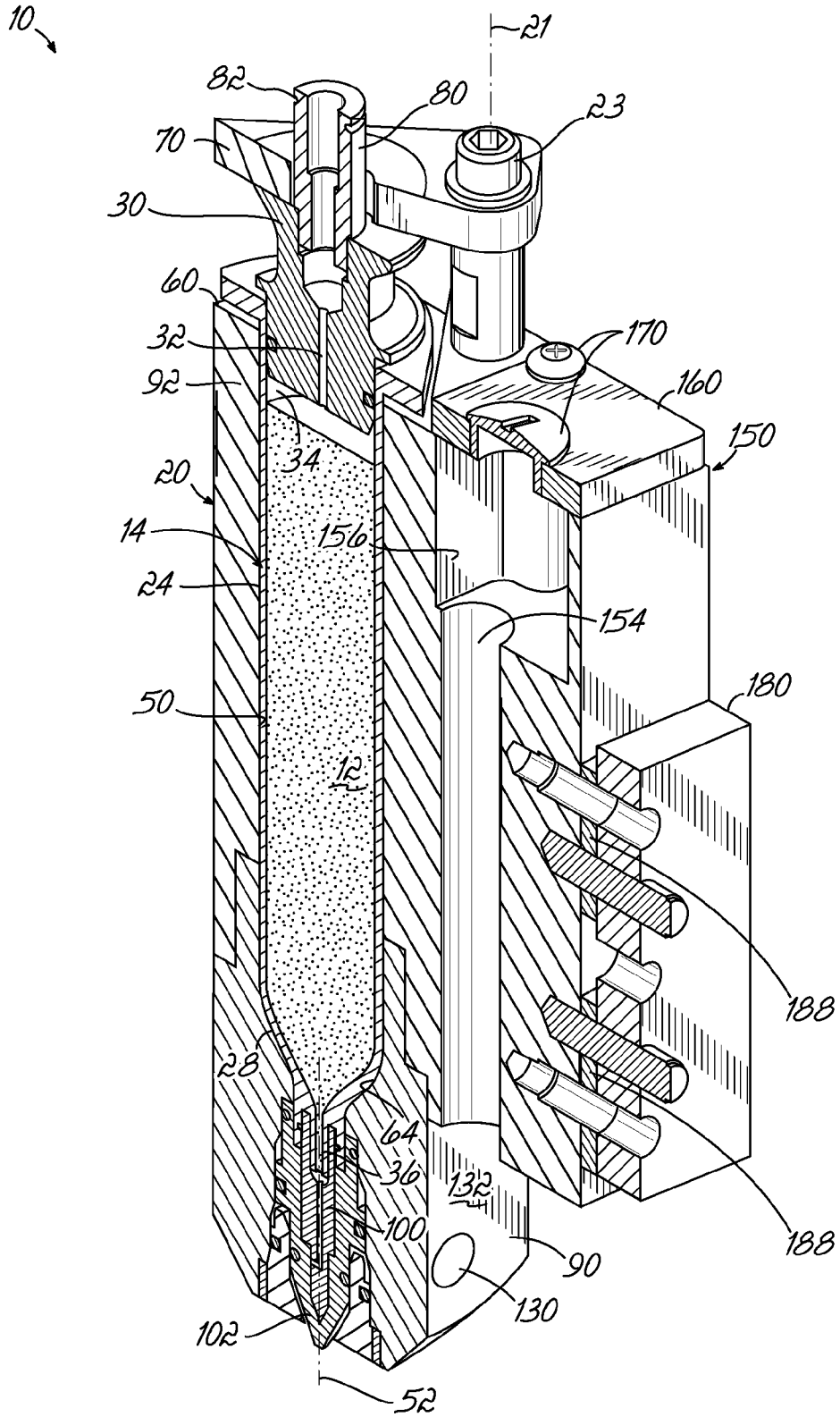
FIG. 5 is a view taken generally along line 5-5 of FIG. 1.

As discussed, above, valve 10 receives at least a portion of the cartridge 14 therein. In this exemplary embodiment, the receiving bore 50 extends generally along a longitudinal axis 52 of valve body 20 and is suitably shaped and sized to receive the exemplary cartridge 14 of FIG. 3 therein. The receiving bore 50 extends between proximal and distal ends 60, 62 of valve body 20 and includes, in this embodiment, a tapered section 64 that facilitates closely receiving barrel 24 of cartridge 14 within valve body 20. Moreover, in this embodiment, the receiving bore 50 includes a coupling portion in the shape of a luer connector 66 (FIG. 2A) that cooperates with a luer coupling element 68 (FIG. 3) of cartridge 14 to secure or at least conform cartridge 14 and valve 10 relative to one another.

The luer connector 66 in this exemplary embodiment may include threads (not shown) that engage cooperating threads (not shown) on luer coupling element 68 of the cartridge 14 to thereby secure the cartridge 14 and valve body 20 relative to one another. Those of ordinary skill in the art will readily appreciate that valve 10 may alternatively include a different type of connector or coupling element or no such structure at all.

With continued reference to FIGS. 1-5, a clasp 70 of the valve 10 is coupled to the proximal end 60 of the valve body 20 and is rotatable into and out of engagement with cartridge 14, to thereby secure cartridge 14 relative to valve body 20. More particularly, clasp 70 is rotatable about a reference axis 21 (FIG. 5) defined by a bolt 23 or similar structure, into engagement with the cap 30 of cartridge 14 and is secured in place relative to valve body 20 via one or more fasteners, for example. In this particular embodiment, once rotated into engagement with cap 30, clasp 70 is secured in place by a bolt or screw 74 (FIG. 1) and a cooperating secondary fastener such as a set screw 75 that frictionally engages bolt or screw 74. It is contemplated that other mechanisms including or obviating fasteners may substitute the fasteners above described to permit clasp 70 or another similar structure to secure cartridge 14 relative to valve body 20. Likewise, it is contemplated that such structure may engage other portions of the cartridge 14 such as, and without limitation, the gripping portion 40.

End surfaces 77, 78 of valve body 20 accommodate gripping portion 40 of cartridge 14 and thereby facilitate limiting of the distal placement (along longitudinal axis 52) of cartridge 14 within valve body 20. An air conduit 80 is adjacent clasp 70 and extends through orifice 32 of cap 30 to communicate with the interior 34 of barrel 24. Air conduit 80 permits coupling of an air source (not shown) to pressurize the interior of barrel 24 and thus facilitate dispensing of liquid 12. To this end, in this embodiment, the exemplary air conduit 80 may include a recess 82 that permits relatively quick coupling of the air source (not shown) with air conduit 80.

In this exemplary embodiment, valve body 20 is defined by a distal portion 90 and a main portion 92 coupled to one another, for example, via fasteners (not shown). This two-part construction of valve body 20 permits, if desired, separation of the portions 90, 92 for cleaning or replacement purposes, for example.

As discussed above, valve 10 is configured to dispense liquid 12 from cartridge 14. To this end, a valve member 100 and a cooperating valve seat element 102 are disposed in distal portion 90 to dispense liquid 12 through a liquid outlet 110 of valve body 20, as explained in further detail below. In operation, the valve member 100 may be pre-coupled to the cartridge 14 outside of valve 10 and then inserted through an opening into bore 50 at proximal end 60. Valve member 100 may be made of any suitable material. For example, and without limitation, valve member 100 may be formed of a plastic material which may also facilitate disposability thereof. The valve seat element 102 may be inserted into valve body 20 through an opening 97 at distal end 62 and secured to valve body 20 via a detachable portion 103. In this exemplary embodiment, detachable portion 103 is in the form of a nut that threadably engages an inner wall 105 of valve body 20, although other forms of detachable portions are contemplated so long as they provide access to an interior of valve body 20 and, more particularly, access to valve seat element 102. Such access may be desirable for cleaning or replacement of valve seat element 102 which may be further made of a plastic material to thereby facilitate disposability thereof.

With continued reference to FIGS. 1-5, the exemplary valve member 100 is a needle-like elongated structure extending generally from the coupling portion 66 of receiving bore 50 and includes a generally L-shaped passage 116 that is in fluid communication with dispensing aperture 36 of cartridge 14 to receive liquid 12 from cartridge 14. Valve member 100 has a generally fixed position relative to valve body 20 and is generally surrounded by valve seat element 102. Valve seat element 102 is movable relative to valve body 20 and thus movable relative to valve member 100. A volume between valve member 100 and valve seat element 102 defines a chamber 104 that fills up with liquid 12 that flows out of passage 116. Detachable portion 103 surrounds a distal portion of valve seat element 102 and restricts distal movement thereof. Valve seat element 102 reciprocates generally in a direction along or parallel to longitudinal axis 52 between an open position and a closed position. In this regard, valve member 100 includes a contacting surface 120 that engages a proximal entrance 122 into liquid outlet 110 when valve seat element 102 is in the closed position. When valve seat element 102 is in the open position, a gap 126 is defined between contacting surface 120 and proximal entrance 122, thereby permitting flow of liquid 12 therethrough. More particularly, when in the open position, gap 126 permits flow of liquid 12 from chamber 104 and through liquid outlet 110, thereby allowing dispensing of liquid 12 out of valve 10 and onto the target (e.g., electronic component 22).

Reciprocating movement of valve seat element 102 results in a corresponding reciprocating movement of liquid outlet 110 toward and away from the target. Moreover, the geometric disposition of the different components described above relative to the cartridge 14 facilitates a relative short path for the liquid 12 to travel as it exits dispensing aperture 36 and leaves valve 10 through liquid outlet 110, which in this embodiment is substantially coaxial with receiving bore 50.

With continued reference to FIGS. 1-5, reciprocating movement of the valve seat element 102 is, in this exemplary embodiment, facilitated by pneumatic components. In particular, an actuation air inlet 130 extends from a peripheral surface 132 of detachable portion 90 and into the valve body 20 to facilitate such reciprocating movement. Inlet 130 communicates with an air feed passage 133 that, in turn, feeds actuation air into the solenoid valve 11 (FIG. 1) through a solenoid air inlet 11*a* of solenoid valve 11. Solenoid valve 11 selectively directs actuation air into valve body 20 through upper and lower actuation air passages 135, 137 disposed within valve body 20. As used herein, the terms "upper," "lower," "up," and "down" and derivatives thereof are not meant to be limiting but rather refer to the illustrative orientations shown in FIGS. 1-5. Upper actuation air passage 135 communicates with a volume defined above an upper surface 139 of valve seat element 102. Lower actuation air passage 137 communicates with a lower surface 141 of valve seat element 102 which is disposed axially opposite from upper surface 139. When the solenoid valve 11 directs air through the upper actuation air passage 135, actuation air pushes down on upper surface 139, thereby causing downward movement of valve seat element 102. This movement, as discussed above, disengages valve seat element 102 from valve member 100, thereby permitting flow of liquid 12 through liquid outlet 110. Conversely, when the solenoid valve 11 directs air through the lower actuation air passage 137, actuation air pushes up on lower surface 141, thereby causing upward movement of valve seat element 102. This movement engages valve seat element 102 with valve member 100, thereby restricting flow of liquid 12 through liquid outlet 110.

While this embodiment illustrates actuation through a solenoid valve 11 that selectively directs actuation air to two separate regions of the valve body 20, those of ordinary skill in the art will readily appreciate that other actuation components and processes may be used instead. For example, and without limitation, actuation may be effected through the combination of air and one or more springs or other biasing elements. Likewise, actuation may be effected through electromagnetic components rather than or in combination with pneumatic and/or mechanical components. Moreover, in the exemplary embodiment of FIG. 1-5, sealing elements restrict passage of air and/or liquid between different components of valve 10. These sealing elements are in the form of o-rings 140 of types and materials known in the art. In this regard, those of ordinary skill in the art will readily appreciate that other types of sealing elements or no sealing elements at all may be used instead.

In some applications it may be desirable to heat the contents of the cartridge 14 while in valve body 20. To this end, a heater box portion 150 of valve body 20 extends along a length of valve body 20 to contain heating components that provide heat to cartridge 14. In particular, heater box portion 150 includes a bore 154 that is adapted to receive a heating element (not shown) therein. A chamber 156 in heater box portion 150 is adapted to hold wires (not shown) connecting the heating element to a power source (not shown). In this illustrative embodiment, which includes no heating element, a cover 160 blocks access to an interior of heater box portion δ 50 and is secured in place via exemplary screws 170.

With continued reference to FIGS. 1-5, the valve body 20 may be coupled to a surrounding structure (not shown) via a mounting block 180 that is spaced from valve body 20 via one or more thermal insulating spacers 188 that reduce the transfer of heat between valve 10 and surrounding structures. This mounting block 180 is merely exemplary and may be replaced by any other type of suitably located mounting structure or no mounting structure at all.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A dispensing valve for dispensing liquid from a cartridge having a barrel defining a volume containing the liquid and a coupling element for coupling the cartridge with the dispensing valve, comprising:

a valve body adapted to receive at least a portion of the cartridge therein;

a valve member disposed in said valve body and including a liquid flow passage inside said valve member and adapted for fluid communication with the cartridge, and said valve member including a coupling element adapted to mate with the coupling element on the cartridge for coupling the cartridge with said valve member; and a valve seat element disposed in said valve body, said valve seat element including a liquid chamber inside said valve seat element and in communication with a liquid outlet and said liquid flow passage, and said valve seat element mounted for reciprocating movement between a closed position engaged with said valve member to prevent liquid from exiting said liquid chamber through said liquid outlet and an open position disengaged from said valve member to allow liquid to flow from the cartridge through said liquid flow passage, and then through said liquid chamber and through said liquid outlet.

2. The dispensing valve of claim 1, wherein said valve body includes a longitudinal axis and a receiving bore extending along said longitudinal axis, said liquid outlet being substantially coaxial with said receiving bore.

3. The dispensing valve of claim 1, wherein said valve body includes a longitudinal axis, said valve seat element being mounted for reciprocating movement substantially along said longitudinal axis.

4. The dispensing valve of claim 1, wherein said coupling element on said valve body includes a luer connector adapted for coupling with the cartridge.

5. The dispensing valve of claim 1, wherein said liquid outlet is disposed in said valve seat element for movement therewith between the open and closed positions.

6. The dispensing valve of claim 1, wherein at least one of said valve member or said valve seat element is formed of a plastic material.

7. The dispensing valve of claim 1, wherein said valve body includes an air inlet for receiving actuation air there through, said valve seat element being in communication with said air inlet and movable between the open and closed positions by action of the actuation air.

8. The dispensing valve of claim 1, wherein said valve body includes a detachable distal portion, removal of said detachable distal portion providing access to said valve seat element.

9. An assembly for dispensing liquid from a cartridge having a barrel defining a volume containing the liquid and a coupling element for coupling the cartridge with the dispensing valve, comprising:

a valve body adapted to receive at least a portion of the cartridge therein;

a solenoid valve coupled to said valve body and in fluid communication therewith;

a valve member disposed in said valve body and including a liquid flow passage inside said valve member and adapted for fluid communication with the cartridge, and said valve member including a coupling element adapted to mate with the coupling element on the cartridge for coupling the cartridge with said valve member; and a valve seat element disposed in said valve body, said valve seat element having opposed surfaces in communication with said solenoid valve and also including a liquid chamber inside said valve seat element and in communication with a liquid outlet and said liquid flow passage, and said valve seat element being mounted for reciprocating movement between a closed position engaged with said valve member to prevent liquid from exiting said liquid chamber through said liquid outlet and an open position disengaged from said valve member to allow liquid to flow from the cartridge through said liquid flow passage, and then through said liquid chamber and through said liquid outlet, said reciprocating movement effected by selective directing of actuation air from said solenoid valve against one of said opposed surfaces of the valve seat element.

10. The assembly of claim 9, wherein said valve body includes an actuation air inlet adapted for coupling with a source of air, said actuation air inlet extending through said valve body and communicating with a solenoid air inlet for feeding of actuation air into said solenoid valve.

11. A method of dispensing liquid from a cartridge supported within a bore of a valve body and having a barrel defining a volume containing the liquid and a coupling element for coupling the cartridge with a dispensing valve, comprising:

coupling a valve member with the cartridge outside of the valve body prior to insertion of the cartridge into the bore of the valve body, wherein coupling includes mating a coupling element on the cartridge with a coupling element on the valve member;

maintaining the valve member, which includes a liquid flow passage inside the valve member and in fluid communication with cartridge, substantially fixed relative to the valve body; and reciprocating a valve seat element between open and closed positions respectively into engagement and out of engagement with the valve member, the valve seat element including a liquid chamber inside the valve seat element in communication with a liquid outlet and the liquid flow passage, the reciprocating movement controlling flow of the liquid from the cartridge through the liquid flow passage and then through the liquid chamber and the liquid outlet out of the valve body.

12. The method of claim 11, further comprising:

pressurizing the liquid within the cartridge.

13. The method of claim 11, further comprising:

supplying heat through the valve body to heat the liquid in the cartridge.

* * * * *

UNITED STATES PATENT AND TRADEMARK OFFICE

CERTIFICATE OF CORRECTION

PATENT NO. : 8,439,226 B2
APPLICATION NO. : 12/367609
DATED : May 14, 2013
INVENTOR(S) : Wesley C. Fort et al.

It is certified that error appears in the above-identified patent and that said Letters Patent is hereby corrected as shown below:

In the Specification:

Column 5

Line 51, change "δ 50" to --150--.

In the Claims:

Column 8

Claim 11, line 11, after "with" insert --the--.

Signed and Sealed this
Twentieth Day of August, 2013

Teresa Stanek Rea
*Acting Director of the United States Patent and Trademark Office*